United States Patent [19]

Pier-Amory et al.

[11] 3,977,295

[45] Aug. 31, 1976

[54] BELT MONITORING APPARATUS

[75] Inventors: Jacques Pier-Amory, Geneva, Switzerland; Giosue Franci, Vimercate Milan, Italy

[73] Assignee: Werkzeugmaschinenfabrik Oerlikon-Buhrle AG, Zurich, Switzerland

[22] Filed: Nov. 14, 1974

[21] Appl. No.: 523,911

[30] Foreign Application Priority Data

Nov. 20, 1973 Switzerland ..... 16329/73

[52] U.S. Cl. ..... 89/137

[51] Int. Cl.[2] ..... F41D 11/00

[58] Field of Search ..... 87/137

[56] References Cited

FOREIGN PATENTS OR APPLICATIONS 584,267 1/1947 United Kingdom ..... 89/137

*Primary Examiner*—Stephen C. Bentley

*Attorney, Agent, or Firm*—Werner W. Kleeman

[57] ABSTRACT

A belt monitoring apparatus for an automatic firing weapon supplied by a cartridge belt and equipped with a pivotable support element, which support element possesses a work position and a rest position, and wherein the trigger of the firing weapon only can be rocked in the work position of the support element into its actuation position and in which work position the support element is retained for such length of time as there are cartridges at the region of a feeler element. A lever system is provided in order to manually rock the support element out of its rest position into its work position.

6 Claims, 8 Drawing Figures

BELT MONITORING APPARATUS

BACKGROUND OF THE INVENTION

The present invention relates to a new and improved construction of belt monitoring apparatus at an automatic firing weapon which is supplied by a cartridge belt and equipped with a pivotable support element, which support element possesses a work position and a rest position, wherein the trigger of the firing weapon only can be rocked in the work position of the support element into its actuation position, in which work position the support element is held for such length of time as cartridges are located at the operable range of a feeler or scanner element.

With a known firing weapon of this type the firing operation is interrupted automatically by a belt monitoring device, as soon as cartridges no longer arrive at the location provided with the feeler element. In so doing, there are still a number of remaining cartridges between the location provided with the feeler element and the breechblock. These cartridges cannot be fired without there being suspended a new cartridge belt at the remaining cartridges, and thus the feeler element brought into such position in which the trigger can again be actuated.

SUMMARY OF THE INVENTION

It is a primary object of the present invention to provide such belt monitoring apparatus in which it is possible to fire the remaining cartridges between the location provided with the feeler element and the breechblock even when there is not attached any new cartridge belt.

According to the invention the above-mentioned object is realized in that there is contemplated the provision of a lever system in order to rock the support element manually out of its rest position into its work position.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
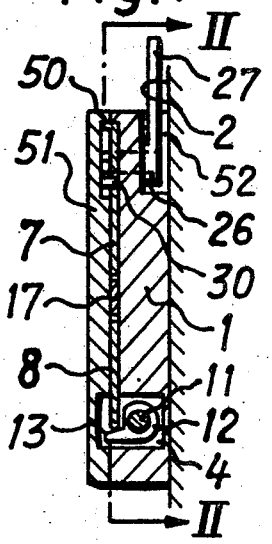
FIG. 1 is a cross-sectional view through a housing containing a control element.

Describing now the drawings, according to the showing of FIG. 1 a housing block 1 together with a rocker or balance 2 is connected with a gun mount which carries an automatic firing weapon which may be of any conventional belt-fed type and therefore has not been particularly shown in the drawings.

Figure 2:
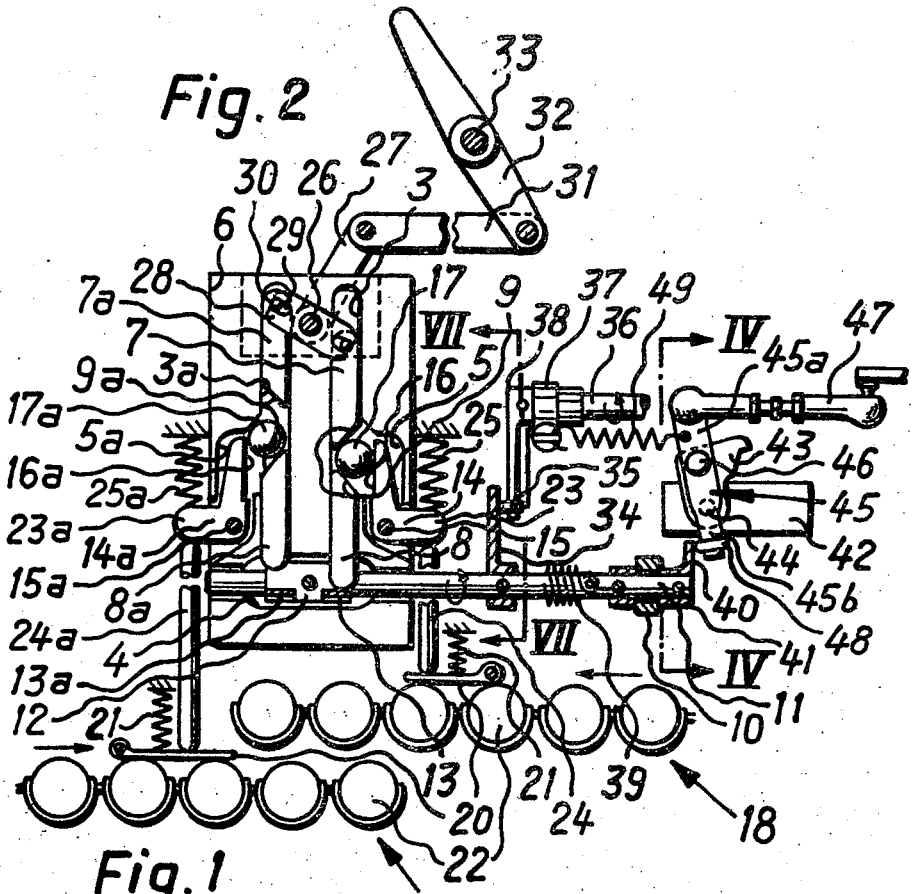
FIG. 2 is a sectional view taken along the line II—II of FIG. 1 with the control element in one functional position.

In a flat or planar surface of the housing 1, according to the showing of FIG. 2, there are milled two grooves 3, 3*a*, which are parallel to the central plane of the housing block 1, and which open into a lower recess 4 of rectangular cross-section and which is directed transverse thereto. Two further grooves 5, 5*a* are parallel to the grooves 3, 3*a* and open laterally into such and furthermore into the side surface or walls 6 of the housing block 1.

In each groove 3, 3*a* there is displaceably mounted a pair of sliding blocks 7, 8 and 7*a*, 8*a*. The confronting inclined surfaces 9, 9*a* of the sliding blocks 7, 8 and 7*a*, 8*a* are located in planes which enclose an obtuse angle with one another. In the housing block 1 and in a carrier or support 10 connected with the balance or rocker 2 there is mounted a shaft 11. At that part of the shaft 11 which is located in the recess 4 there is keyed a cylindrical control element or piece 12 having two tangential and similarly directed tongues 13, 13*a*. In the grooves 5, 5*a*, there are arranged the angle levers 14, 14*a* which are rotatably mounted at the shafts 15, 15*a* fixed to the housing. Between the inclined surfaces 9, 9*a* of the sliding blocks 7, 8, 7*a*, 8*a* and the surfaces 16, 16*a* of the angle levers 14, 14*a* there are arranged the circular disks 17, 17*a*.

In FIG. 2 there are schematically illustrated two cartridge belts 18, 19 which are movable in opposite directions to the firing weapon. Two feeler or scanner elements 20 in the form of feeler or scanner levers are hinged at a belt guide element which has not been particularly illustrated in the drawing and bear under the pressure of springs 21 at a respective associated cartridge belt 18, 19. Each belt contains *n* cartridges 22. Between the feeler or scanner elements 20 and the arms 23, 23*a* of the angle levers 14, 14*a* and which arms protrude out of the housing block 1 there are inserted the connection or transmission elements 24, 24*a*, which provide a form locking or positive connection between these components 20 and 23. The arms 23, 23*a* of the angle levers 14, 14*a* are held under the pressure of the springs 25, 25*a* to bear at the transmission elements 24, 24*a*.

In the housing block 1 there is rotatably mounted a shaft 26 which is fixedly connected with a lever 27 and with a double-arm lever 28. The lever 27 is pivotable in a milled portion or recess 52 applied at the rear side of the housing block 1. The arms of the lever 28 possess at the ends slots 29 in which engage pins 30 connected with the sliding blocks or elements. A lever 31 is hingedly connected with the lever 27 and with an adjustment lever 32 which is rotatably mounted at a shaft 33 connected with the balance or rocker 2. The lever 28 engages in a recess 50 of a cover 51 placed upon the housing block 1. The lever 32 and the lever 28 respectively, are connected with a not particularly illustrated ammunition change mechanism.

A lever 34 possesses a cam or dog 35 and is keyed to the shaft or axle 11. A shaft 36 is mounted in a carrier or support 37 connected with the balance or rocker 2.

A lever 38 is fixedly connected with the shaft 36. The axle or shaft 11 is loaded by a spiral spring 39 which strives to rotate such in the clockwise direction (viewed in FIG. 4). A supporting element 40 of essentially circular sector-shape is connected with a hub 41 which is keyed to the shaft 11.

Figure 4:
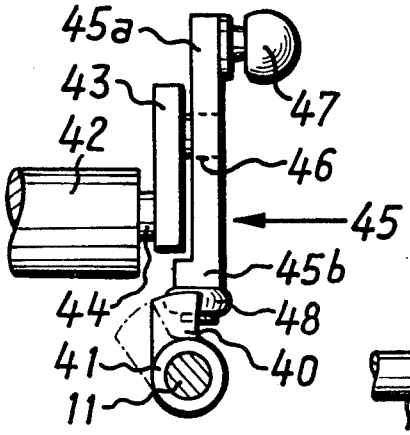
FIG. 4 is a sectional view taken along the line IV—IV of FIG. 2.

According to the showing of FIG. 4 an intermediate lever 43 seated at a shaft 44 is rotatably mounted in a trigger housing 42 which is fixedly connected with the rocker or balance 2. A double-arm lever 45 is rotatably mounted at a shaft 46 fixedly connected with the intermediate lever 43. The one end 45*a* of the lever 45 is hingedly connected with a trigger rod 47, and the cylindrical end of the other arm 45*b* possesses a ringshaped enlarged portion 48. A tension spring 49 is spanned between the support or carrier 37 and the lever arm 45*a*.

The mode of operation of the described apparatus is as follows: According to the showing of FIG. 2 the belt 18 is moved in the direction of the arrow. The lever 28 is adjusted such that the sliding block 7 is supported at the disk 17, such at the sliding block 8, and such at the tongue 13 of the control element 12, so that the spiral or bending spring 39 is held in a spanned or stressed state as long as cartridges 22 move below the feeler or scanner element 20. Both of the other sliding blocks 7*a*, 8*a* are spaced so far from one another that by means of the disk 17*a* no force is transmitted to the sliding block 8*a* and thus also no force to the control element 12.

Figure 5:
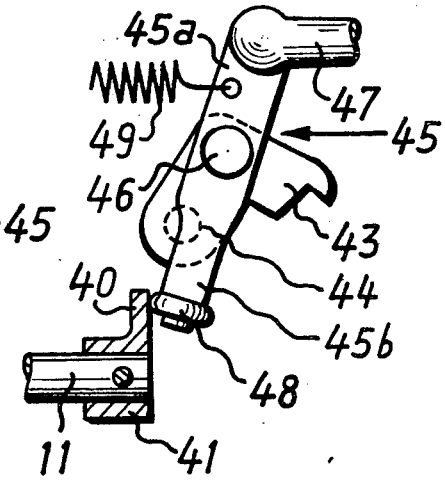
FIG. 5 is an actuation mechanism illustrated in FIG. 2 in a second functional position.
Figure 7:
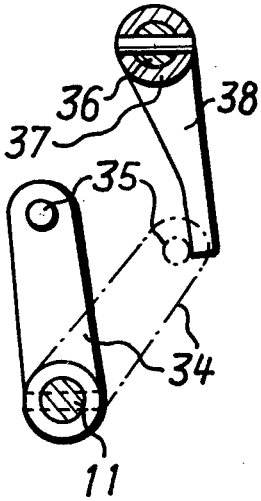
FIG. 7 is a sectional view taken along the line VII—VII of FIG. 2.

Both of the levers 34 and 38 are located in the position illustrated in FIG. 7. The end of the lever arm 45*a* is located behind the support element 40 (FIGS. 2, 4 and 5). For the purpose of triggering a shot or firing the weapon the trigger rod 47 (viewed in FIG. 2) is moved towards the right. Consequently, the lever 45 which bears at the support element 40 together with the shaft 46 under the tension of the spring 49 carries out a rocking movement about the support point, whereby the intermediate lever 43 carries out a rocking movement about the shaft 44 (FIG. 5).

Figure 3:
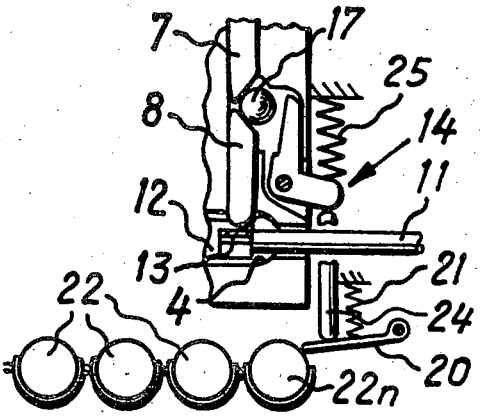
FIG. 3 is an illustration corresponding to the showing of FIG. 2 for a further functional position of the control element.

During the rocking of the intermediate lever 43 and the shaft 44 fixedly connected therewith the further not-illustrated trigger of the firing weapon is actuated and the firing operation is triggered or released. During the firing operation the cartridge belt 18 moves below the feeler element 20. When the last cartridge ($22_n$) of the belt 18 has passed the feeler element 20 then such, under the action of the springs 21 and 25 (viewed in FIG. 3) is rocked in the counter clockwise direction. The transmission element 24 follows the angle lever 14 which is rocking or pivoting under the pressure of the spring 25. The disk 17 deviates laterally since the sliding block 8 is moved towards the sliding block 7 (FIG. 2) due to the tongue 13 of the shaft 11 which rotates under the action of the spring 39 (FIG. 2).

Figure 6:
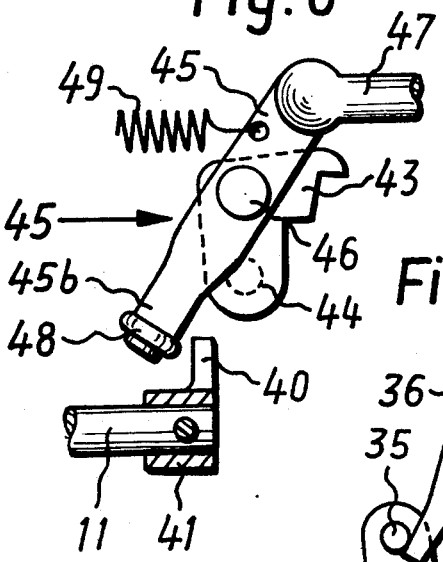
FIG. 6 is an illustration of a further functional position corresponding to the showing of FIG. 5.

The lever 34 is rocked with the shaft 11 until it bears by means of its cam or dog 35 at the lever 38 (shown in broken lines in FIG. 7). Consequently, the support element 40 secured to the shaft 11 no longer supports the lever end 45*b*. By means of the spring 49 the lever 45 (viewed in FIG. 6) is drawn towards the left, whereby the intermediate lever 43 is rocked in the counter clockwise direction with the shaft 44 and thus the firing operation is interrupted. Now when the gunner releases the trigger then the trigger rod 47 with the levers 43, 45 are again returned by the spring 49 into the positions according to FIG. 2.

When a new belt is suspended at the end $22_n$ of the remainder of the belt located between the feeler element 20 and the weapon, then the feeler element 20 (viewed in FIG. 3) is rocked back in the clockwise direction, so that the angle lever 14 is rocked by the transmission element 24 and thus the disk 17 is pressed between both of the sliding blocks 7, 8. The sliding block 8 thus moves downwardly, so that the shaft 11 is rotated and the spring 39 is tensioned. The lever end 45*b* is now again positioned behind the support element 40, the shaft 44 can again be rocked and the weapon is again ready to be fired.

Figure 8:
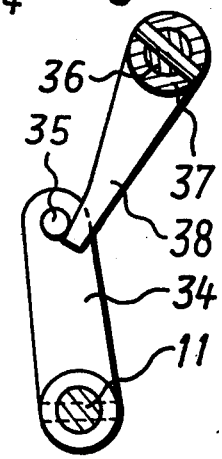
FIG. 8 illustrates the actuation lever illustrated in FIG. 7 in a further functional position.

If, however, no new belt is suspended or connected, rather the remainder of the belt located still between the feeler element 20 and the breechblock should be fired, then the shaft 36 (viewed in FIG. 7) is manually rotated in the clockwise direction. Consequently, the lever 34 is rocked into the position illustrated in FIG. 8, with the result that due to rotation of the shaft 11 the spring 39 is tensioned and the support element 40 is positioned behind the lever end 45*b*. In the already described manner by pulling at the trigger rod 47 the intermediate lever 43 with the shaft 44 can be rocked and the firing operation released and the remainder of the belt can be fired.

By rocking the lever 32 it is possible by means of the control elements 7*a*, 8*a*, 17*a* and 24*a* to bring about the same conditions for the automatic interruption of the firing operation during firing of the ammunition out of the belt 19, as has been previously described for the belt 18.

While there is shown and described present preferred embodiments of the invention, it is to be distinctly understood that the invention is not limited thereto, but may be otherwise variously embodied and practiced within the scope of the following claims.

Accordingly, what is claimed is:

1. A belt monitoring apparatus for an automatic firing weapon supplied by a cartridge belt, comprising a feeler cooperating with a cartridge belt, a pivotable support element, said support element assuming a work position and a rest position, said firing weapon having a trigger, the trigger of the firing weapon being pivotable only in the work position of the support element into its actuation position and in which work position the support element is retained for such length of time as cartridges are located at the region of the feeler element, a lever system for manually rocking the support element out of its rest position into its work position, a lever having an end bearing at the support element, said lever being pivotably mounted via an intermediate lever at a stationary housing, one end of the intermediate lever being pivotably mounted at the housing through the agency of a first shaft which is operatively connected with the trigger, and the other end of the intermediate lever being pivotably connected via a second shaft with the lever and that a second end of the aforesaid lever is connected with a trigger rod.

2. A belt monitoring apparatus for an automatic firing weapon supplied by a cartridge belt, comprising:

a. a feeler cooperating with a cartridge belt;

b. a pivotable support element:

i. said support element assuming a work position and a rest position;

c. said firing weapon having a trigger means:

i. the trigger means of the firing weapon being pivotable only in the work positon of the support element into its actuation position and in which work position the support element is retained for such length of time as cartridges are located at the region of the feeler element;

d. a lever system for manually rocking the support element out of its rest position into its work position;

e. said pivotable support element is connected via a shaft with a first lever of the lever system;

f. a second lever of the lever system for actuating said first lever; and g. a spring engaging with said shaft which strives to retain the support element in its rest position.

3. The belt monitoring apparatus as defined in claim 2, further including a control element secured to said shaft, said control element being connected with the feeler element through the agency of an actuation mechanism.

4. The belt monitoring apparatus as defined in claim 3, where the actuation mechanism comprises two sliding blocks between which there is located a disk, said sliding blocks having inclined surfaces, wherein the one sliding block can be displaced out of an ineffectual position into an effectual position, said disk bearing at an angle lever and at the inclined surfaces of both sliding blocks provided that the one sliding block is located in its effectual position, and said angle lever bearing via a connection element at the feeler element.

5. The belt monitoring apparatus as defined in claim 4, especially for a firing weapon supplied with two cartridge belts each having a respective feeler element for each cartridge belt, and with a switching mechanism for the selective monitoring of one or the other of the cartridge belts, the improvement wherein for each belt there is provided an actuation mechanism containing said sliding blocks, and wherein a double-arm lever which is manually operable is connected with one sliding block of the one actuation mechanism and with one sliding block of the other actuation mechanism for displacing one sliding block into the effectual position and for the simultaneous displacement of the other sliding block of the other actuation mechanism into its ineffectual position.

6. The belt monitoring apparatus as defined in claim 4, wherein the inclined surfaces of both sliding blocks are directed towards one another and enclose an obtuse angle.

* * * * *